US006910292B2

(12) United States Patent
Prows

(10) Patent No.: US 6,910,292 B2
(45) Date of Patent: Jun. 28, 2005

(54) CLOTHES DRYING CABINET WITH IMPROVED AIR DISTRIBUTION

(75) Inventor: Dennis S. Prows, Cincinnati, OH (US)

(73) Assignee: Maytag Corporation, Newton, IA (US)

( * ) Notice: Subject to any disclaimer, the term of this patent is extended or adjusted under 35 U.S.C. 154(b) by 29 days.

(21) Appl. No.: 10/361,896

(22) Filed: Feb. 6, 2003

(65) Prior Publication Data

US 2004/0154194 A1 Aug. 12, 2004

(51) Int. Cl.[7] ..... D06F 58/10
(52) U.S. Cl. ..... 38/14; 38/1 A
(58) Field of Search ..... 68/5 C, 5 R, 12.08, 68/12.09; 38/1 R, 7, 14, 1 A; 223/51, 73, 70; 34/343, 376, 428, 619, 621, 201

(56) References Cited

U.S. PATENT DOCUMENTS

| | | | | |
|---|---|---|---|---|
| 2,443,069 A | | 6/1948 | Gayring | |
| 3,197,886 A | | 8/1965 | Brame et al. | |
| 3,256,616 A | | 6/1966 | McGoldrick | |
| 3,417,481 A | | 12/1968 | Rumsey, Jr. | |
| 3,594,917 A | | 7/1971 | Montgomery | |
| 3,601,292 A | | 8/1971 | Bliss | |
| 3,670,425 A | | 6/1972 | Benjamin et al. | |
| 3,712,086 A | | 1/1973 | Payet et al. | |
| 3,739,496 A | | 6/1973 | Buckley et al. | |
| 3,805,561 A | | 4/1974 | Bullock | |
| 3,849,815 A | | 11/1974 | Frauendorf | |
| 4,304,053 A | | 12/1981 | Kellerhals et al. | |
| 4,434,564 A | | 3/1984 | Braggins, Jr. | |
| 4,493,160 A | * | 1/1985 | Brembilla et al. | 38/14 |
| 4,625,432 A | | 12/1986 | Baltes | |
| 4,819,341 A | | 4/1989 | Gayso | |
| 5,094,020 A | | 3/1992 | Wingfield et al. | |
| 5,107,603 A | | 4/1992 | Durazzani | |
| 5,152,077 A | | 10/1992 | Liang | |

(Continued)

FOREIGN PATENT DOCUMENTS

| | | |
|---|---|---|
| EP | 0 758 694 A1 | 2/1997 |
| EP | 0816522 A3 | 1/1998 |
| EP | 0816522 B1 | 1/1998 |
| GB | 2 238 322 A | 5/1991 |
| GB | 2 289 752 A | 11/1995 |
| GB | 2 321 954 A | 8/1998 |
| GB | 2 345 493 A | 7/2000 |
| JP | 01-303199 | 12/1989 |
| JP | 3207399 | 9/1991 |
| JP | 3289999 | 12/1991 |
| JP | 4089099 | 3/1992 |
| JP | 404084998 A | 3/1992 |
| JP | 4126198 | 4/1992 |
| JP | 4144599 | 5/1992 |
| JP | 404156896 A | 5/1992 |
| JP | 404187194 A | 7/1992 |
| JP | 5208096 | 8/1993 |
| JP | 405208096 A | 8/1993 |
| JP | 406339598 A | 12/1994 |
| JP | 409053880 A | 2/1997 |
| WO | WO 95/32330 | 11/1995 |
| WO | WO 00/75413 A1 | 12/2000 |

OTHER PUBLICATIONS

SHARP Press Release, Feb. 19, 2001.
The Laundry Alternative Web Site, Oct. 30, 2002, pp. 1–2.
Anthony Star and Cindy Vasquez, Wet Cleaning Equipment Report, May 1997, pp. 1–19.
Total Laundry Solution, Oct. 30, 2002, pp. 1–3.

*Primary Examiner*—Ismael Izaguirre
(74) *Attorney, Agent, or Firm*—Allan P. Orsund; McKee, Voorhees & Sease

(57) ABSTRACT

A clothes drying cabinet is provided with an internal compartment for receiving clothes and having a plurality of air inlet nozzles. An air plenum provides air to the cabinet through the nozzles. The plenum has a decreasing cross section from one corner to an opposite corner to provide a balanced distribution of air through the nozzles at a substantially uniform velocity. The nozzles are angularly oriented to direct air across upper and lower surfaces of shelves mounted within the drying compartment.

41 Claims, 10 Drawing Sheets

U.S. PATENT DOCUMENTS

| | | | | |
|---|---|---|---|---|
| 5,305,484 | A | | 4/1994 | Fitzpatrick et al. |
| 5,369,892 | A | | 12/1994 | Dhaemers |
| 5,516,012 | A | | 5/1996 | Weigel |
| 5,555,640 | A | | 9/1996 | Ou |
| 5,730,006 | A | | 3/1998 | Conley |
| 5,755,040 | A | | 5/1998 | Ou |
| 5,815,961 | A | | 10/1998 | Estes et al. |
| 5,987,773 | A | | 11/1999 | Lipscy |
| 5,996,249 | A | | 12/1999 | Manning |
| 6,018,885 | A | * | 2/2000 | Hill ..... 34/202 |
| 6,189,346 | B1 | | 2/2001 | Chen et al. |
| 6,263,591 | B1 | | 7/2001 | La Porte |
| 6,363,627 | B1 | | 4/2002 | Lai |
| 6,405,461 | B1 | * | 6/2002 | Groel et al. ..... 38/1 A |
| 6,425,192 | B2 | | 7/2002 | Arrieta et al. |
| 6,845,569 | B1 | * | 1/2005 | Kim ..... 34/106 |
| 2004/0134087 | A1 | | 7/2004 | Meyer |

* cited by examiner

CLOTHES DRYING CABINET WITH IMPROVED AIR DISTRIBUTION

BACKGROUND OF THE INVENTION

Clothes drying cabinets, which are more common in Japan than in the United States, are used for drying clothes without the conventional tumbling action. As opposed to a conventional tumbler dryer, a drying cabinet provides heated air for drying clothes hanging in the cabinet. Drying cabinets can also be used for de-wrinkling clothes. The de-wrinkling process includes the introduction of steam into the cabinet, which facilitates the removal of wrinkles from the clothes. The drying air is provided through multiple holes or louvers formed in one or more walls of the drying cabinet. However, conventional drying cabinets generally do not provide a balanced air flow through the cabinet, since the velocity of air flow through the inlet holes or louvers is greatest near the air supply source and progressively decreases as the inlet holes or louvers are spaced farther from the air supply source. Also, the drying air normally enters the cabinet through the holes or louvers in a common direction, which minimizes or reduces the mixture of drying air within the cabinet.

Conventional drying cabinets also do not have shelves for receiving clothes to be dried, such as sweaters which preferably should not be hung on a hanger, particularly when wet.

Accordingly, a primary objective of the present invention is the provision of an improved clothes drying cabinet.

Another objective of the present invention is the provision of an improved clothes drying cabinet having balanced air distribution throughout the cabinet.

A further objective of the present invention is the provision of an improved clothes drying cabinet wherein drying air is introduced through holes or nozzles in the cabinet wall at a substantially uniform velocity.

Another objective of the present invention is the provision of an improved clothes drying cabinet wherein the drying air is introduced through a plurality of air inlet holes or nozzles at multiple non-horizontal angles.

Another objective of the present invention is the provision of an improved clothes drying cabinet having shelves for drying clothes thereon, and with drying air directed to both the upper and lower surfaces of the shelves.

A further objective of the present invention is the provision of an improved clothes drying cabinet wherein an air plenum directs drying air into the cabinet uniformly.

Another objective of the present invention is the provision of an improved clothes drying cabinet wherein an air distribution plenum has a decreasing cross sectional area, both horizontally and vertically, to provide substantially constant velocity air flow into the drying cabinet.

Another objective of the present invention is the provision of an improved clothes drying cabinet which also distributes steam in the cabinet for de-wrinkling clothes.

These and other objectives of the present invention will be apparent from the following description.

SUMMARY OF THE INVENTION

A clothes drying cabinet has a compartment with a front door or doors, opposite side walls, a rear wall, a top wall, and a bottom wall. A plurality of air inlet holes or nozzles are provided in one of the walls. An air plenum resides behind the air nozzles to distribute air from an air source through the nozzles and into the compartment for drying clothes therein. The air plenum has a cross sectional area which decreases from the nozzles closest to the air source to the nozzles furthest from the air source, so as to provide a substantially constant air flow velocity through the nozzles into the compartment. The nozzles are directed in an angular, non-horizontal orientation so as to provide drying air in multiple directions into the compartment. Mesh shelves may be provided in the compartment, with the air being directed to both the upper and lower surfaces of the shelves to enhance drying of objects laid on the shelves.

DETAILED DESCRIPTION OF THE INVENTION

Figure 1:
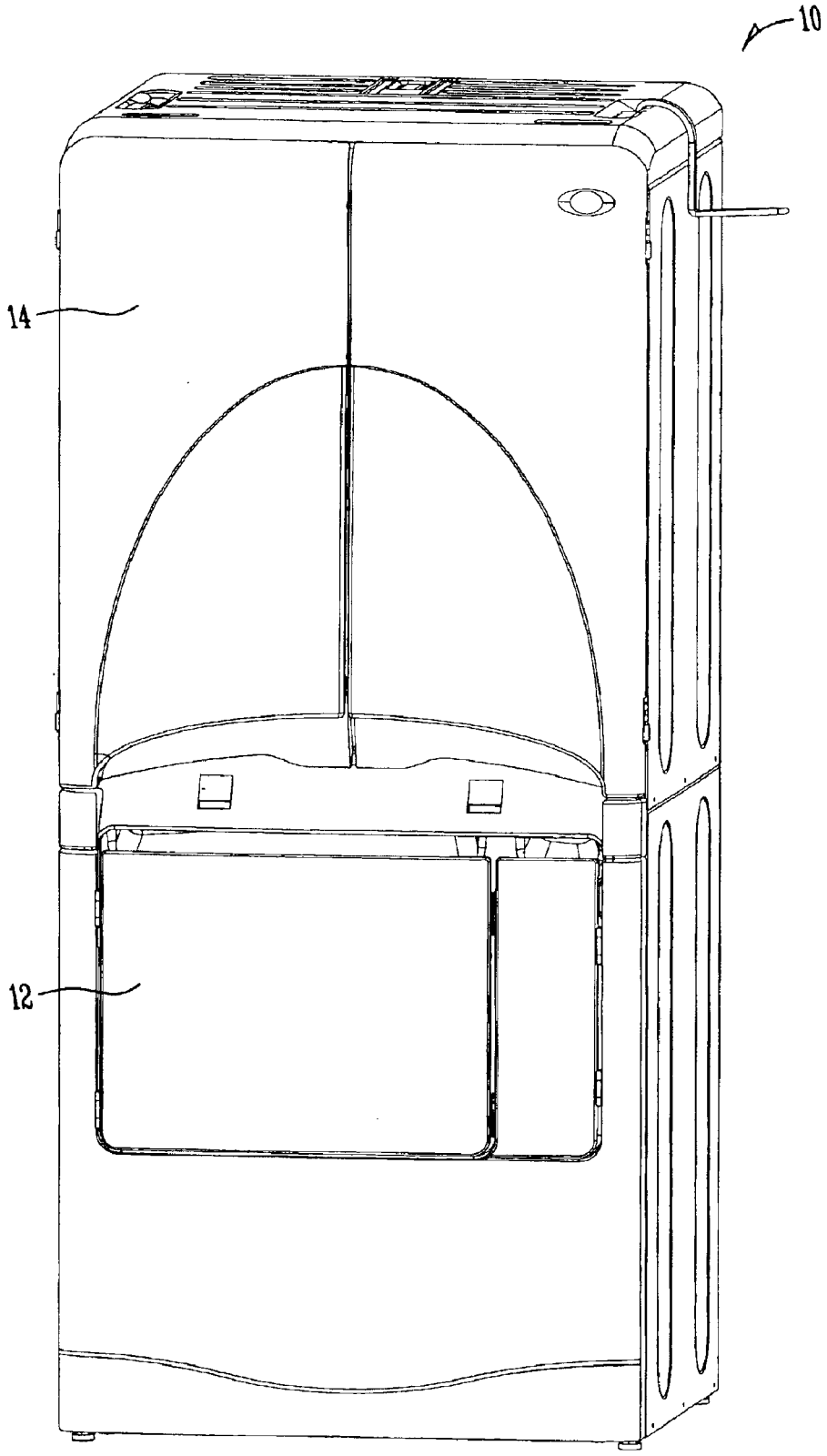
FIG. 1 is a perspective view of a combination tumble dryer and drying cabinet with the front doors closed.

FIG. 1 shows a combination clothes drying machine 10 having a tumble dryer 12 and a drying cabinet 14. The drying cabinet 14 is shown to be mounted on top of the tumble dryer 12, though it is understood that other configurations can be provided. The tumble dryer 12 includes a door to provide access to the rotatable drum 18.

Figure 2:
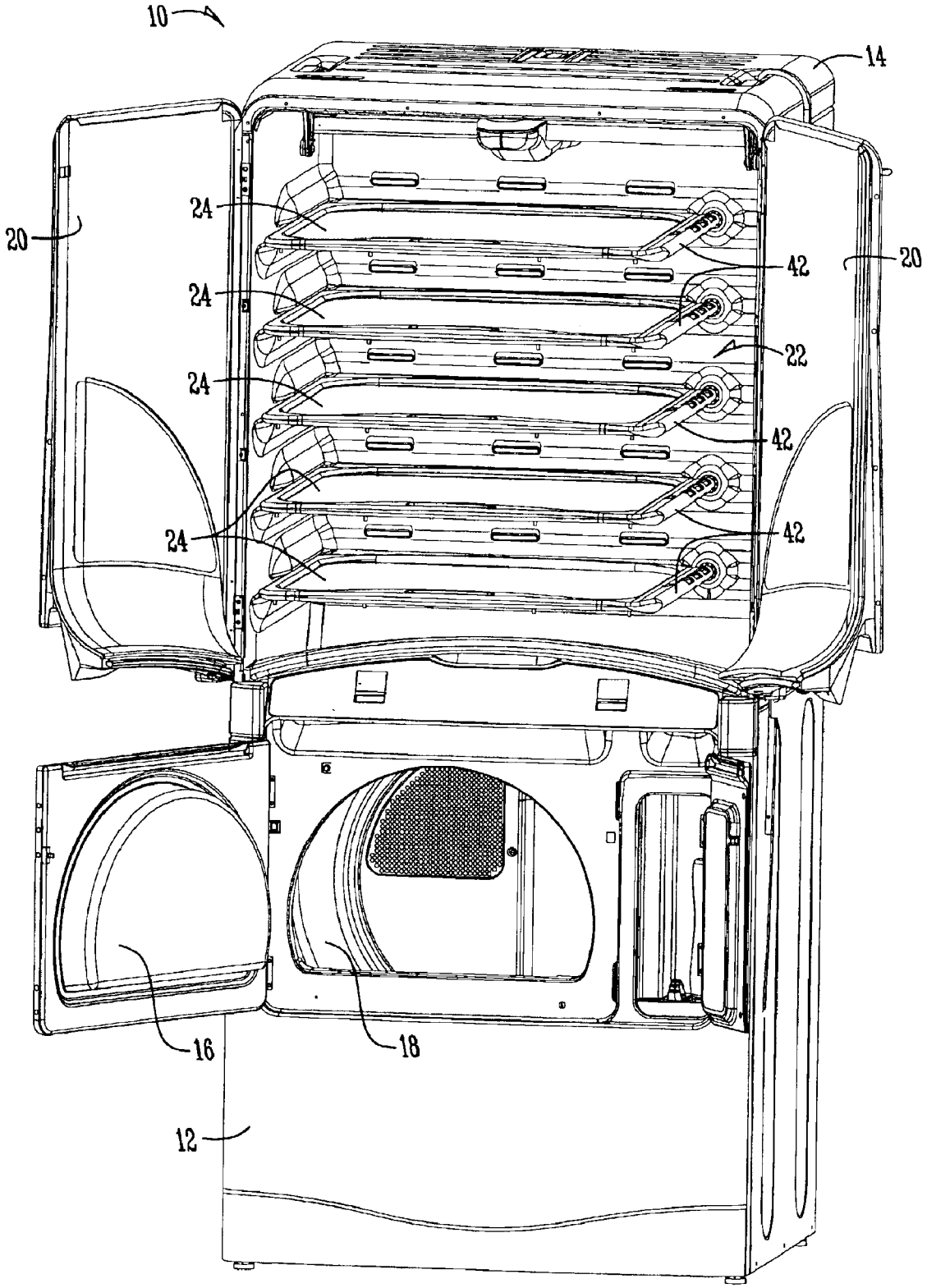
FIG. 2 is a view similar to FIG. 1 showing the front doors open.
Figure 4:
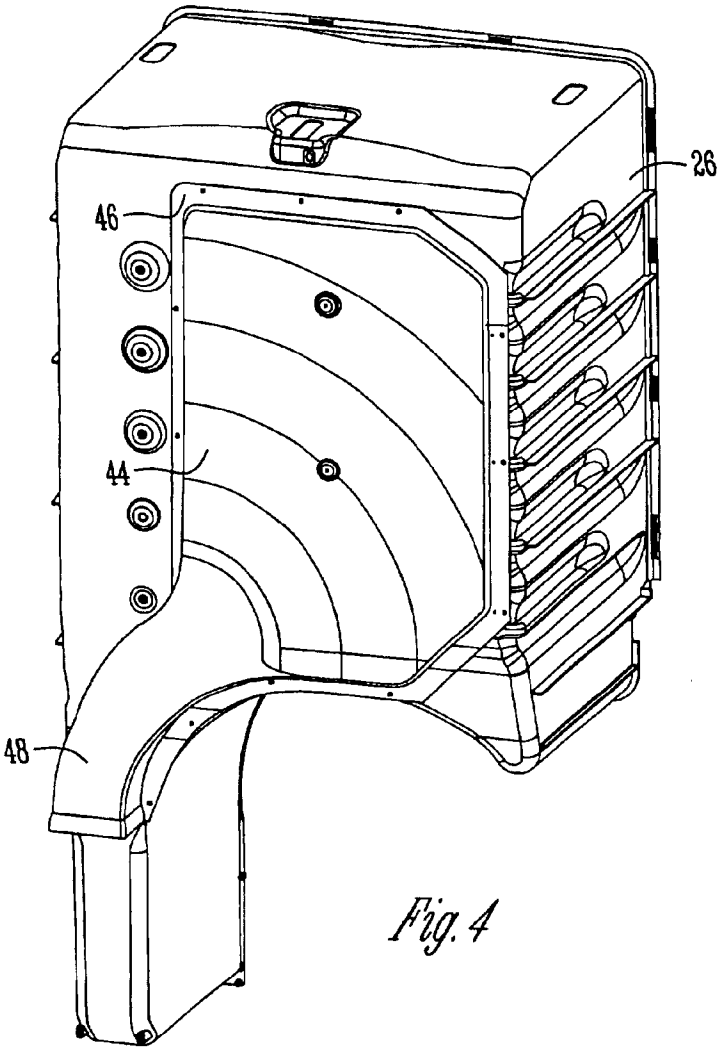
FIG. 4 is a rear perspective view of the cabinet dryer liner with the air plenum wall secured thereto.

The drying cabinet 14 includes a pair of doors 20 which provide access to a drying compartment 22. As seen in FIG. 2, the compartment 22 may include removable shelves 24, which preferably have a mesh support surface so that air can circulate therethrough.

Figure 3:
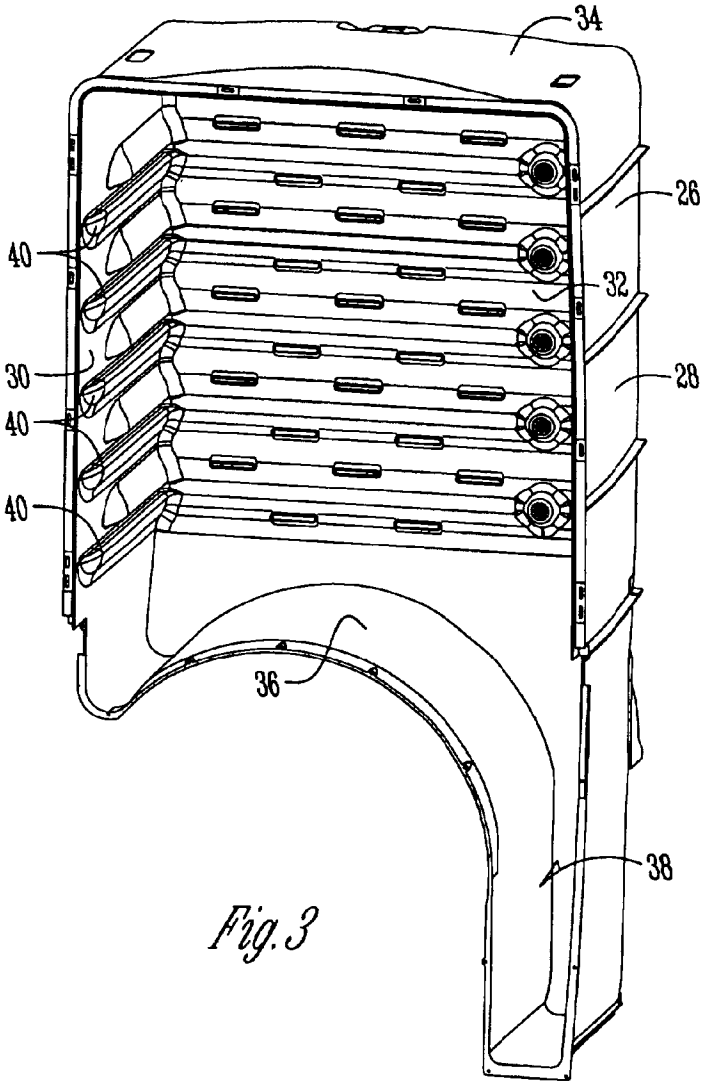
FIG. 3 is a front perspective view of the drying cabinet liner.
Figure 5:
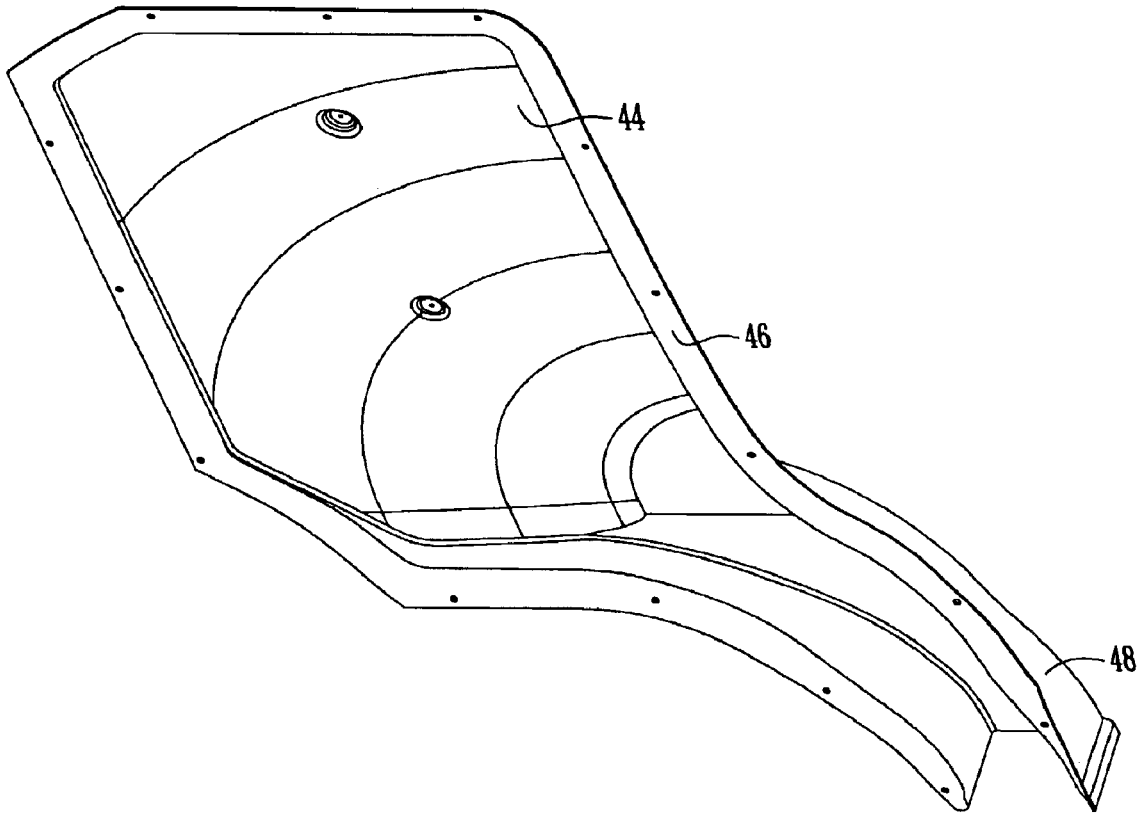
FIG. 5 is a front perspective view of the air plenum wall.
Figure 6:
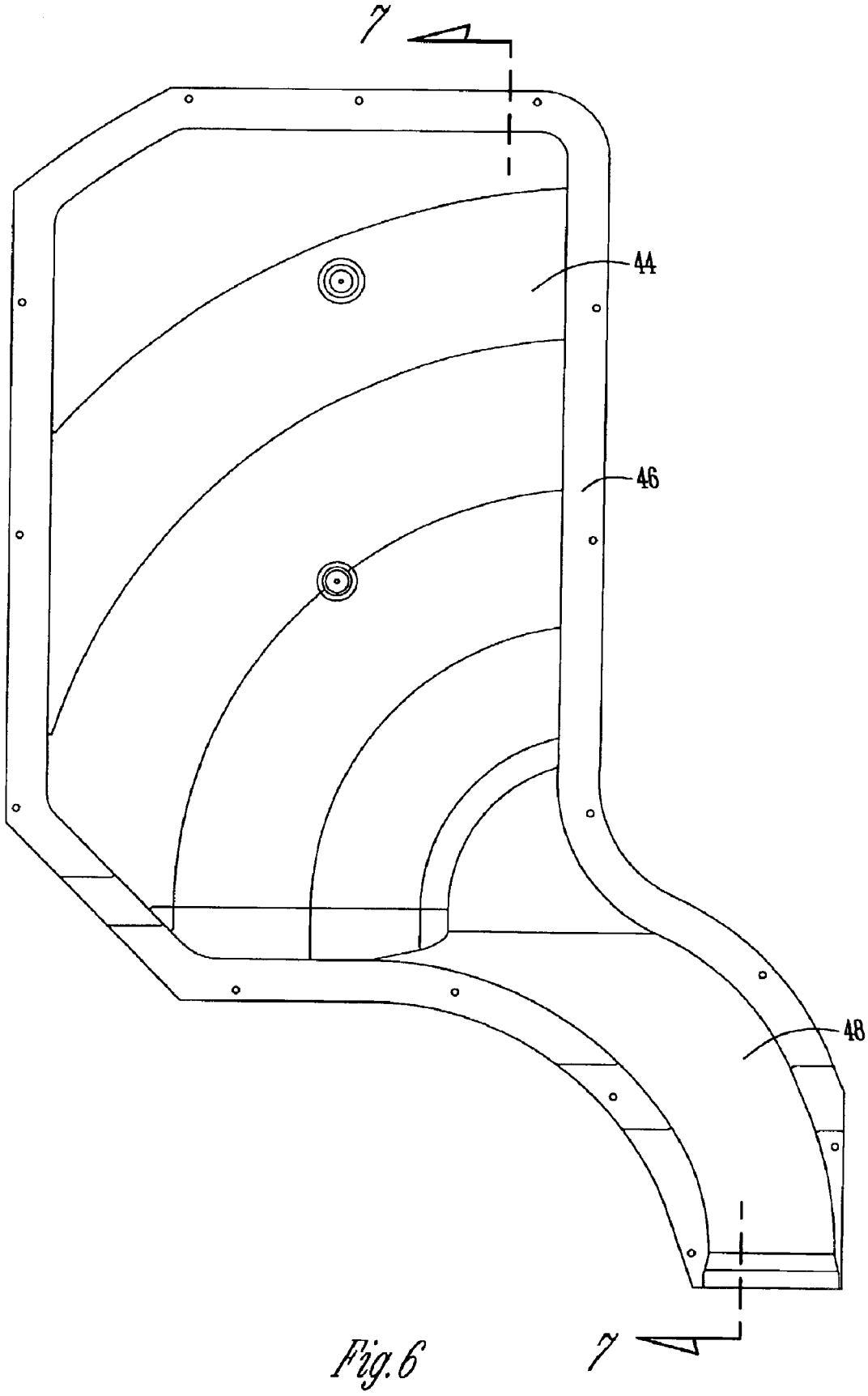
FIG. 6 is a front elevation view of the air plenum wall.
Figure 7:
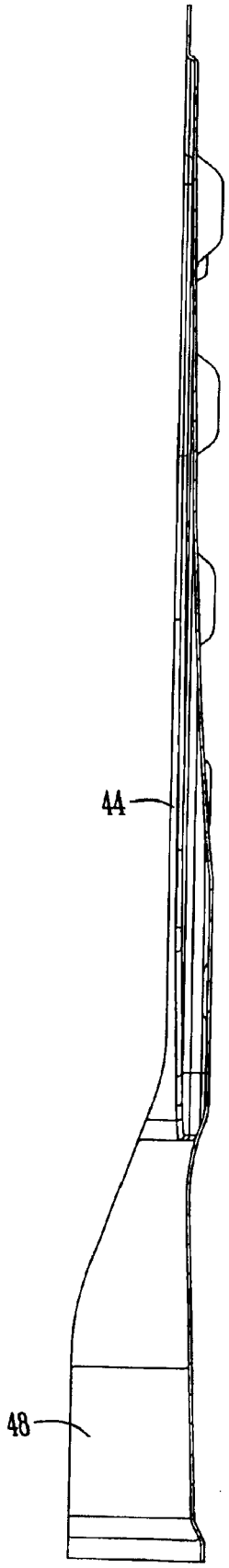
FIG. 7 is a sectional view taken along lines 7—7 of FIG. 6.

The compartment 22 is formed by a liner 26, best shown in FIG. 3. The liner 26 includes opposite side walls 28, 30, a rear wall 32, a top wall 34, and a bottom wall 36. The bottom wall 36 has a curved profile so as to extend around the drum 18 of the tumble dryer 12. The compartment 22 includes an elongated portion 38 adapted to receive long hanging items for drying, such as a dress.

A plurality of shelf supports 40 are formed on the wall 30. Shelf support rods 42 are removably mounted in the rear wall 32 of the liner 26. Thus, the shelves 24 can be quickly and easily installed and removed with the opposite rigid sides of the shelves being supported by the shelf supports 40 and shelf rods 42. It is understood that other means may be provided for supporting the shelves 24.

A plenum wall 44 is mounted on the exterior of the rear wall 32 of the liner 26. The plenum wall 44 includes a perimeter flange 46. A seal (not shown) is provided between the perimeter flange 46 and the rear wall 32 of the liner 26.

The plenum wall 44 includes a lower portion 48 adapted to be connected to an air duct (not shown). The air duct conveys air from an air source, such as a fan, to the air plenum 50 defined by the space between the plenum wall 44 and the rear wall 32. The air may be heated to enhance drying and may carry steam to enhance de-wrinkling of clothes within the drying cabinet 14.

As seen in FIGS. 8 and 9A–9E, the cross sectional area of the plenum 50 decreases across the width of the plenum 50, with the greatest cross sectional area being adjacent the lower portion 48. Similarly, as shown in FIGS. 10 and 11A–11E, the cross sectional area of the plenum 50 decreases vertically from bottom to top, with the greatest cross sectional area being adjacent the lower portion 48 of the plenum wall 44. Thus, the plenum 50 has the greatest cross sectional area in the lower right corner, as shown in the drawings adjacent the introduction of air from the air inlet portion 48 and has the smallest cross sectional area in the opposite (upper left) corner furthest away from the air inlet portion 48. This gradual decrease in the depth of the plenum 50 in a radial pattern allows the air to be distributed through a plurality of air inlet holes or nozzles 52, 54 in the rear wall 32 of the compartment 22 at a substantially constant or uniform velocity. Thus, the air distribution through the nozzles 52, 54 is balanced across the rear of the compartment 22.

Figure 8:
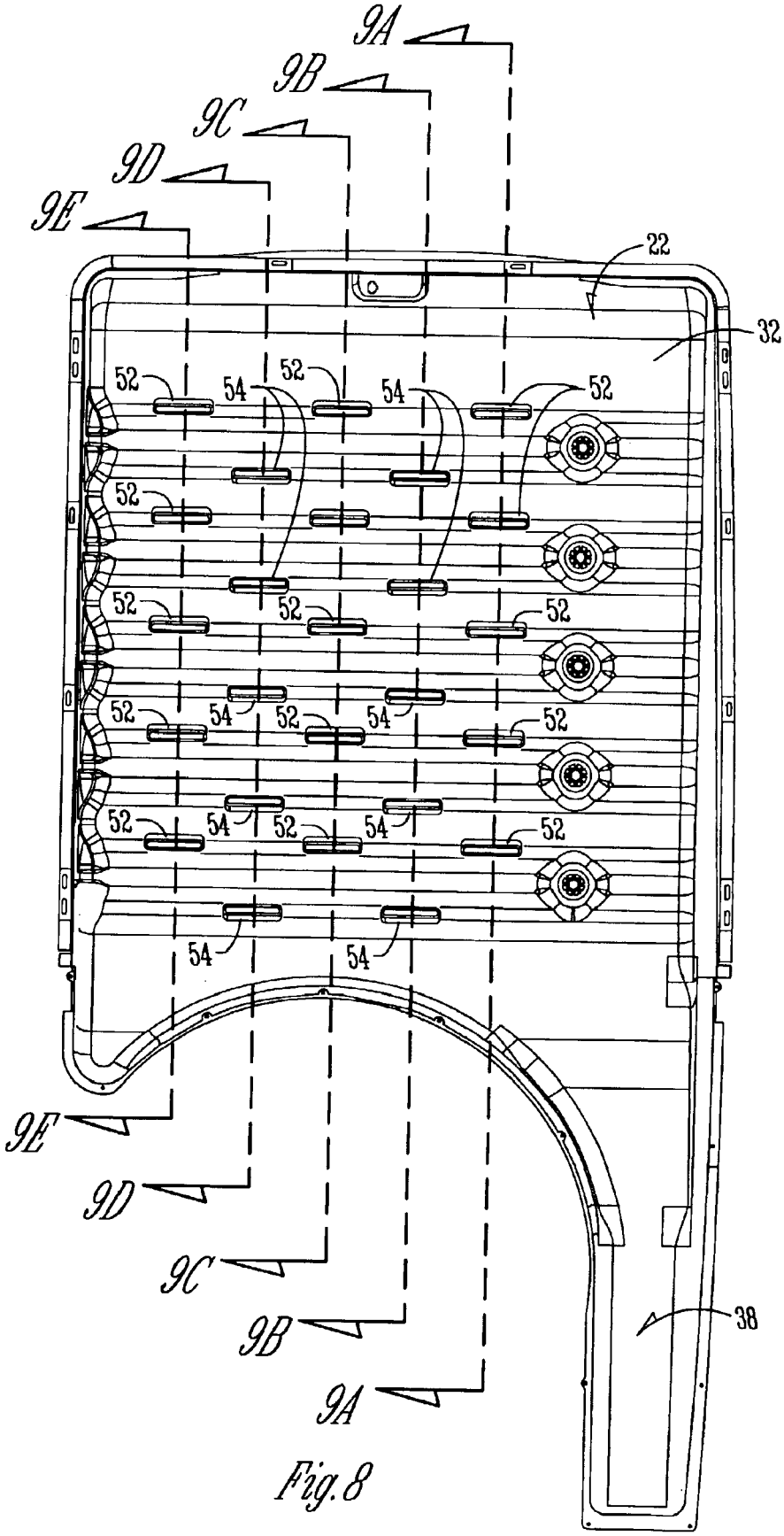
FIG. 8 is a front elevation view of the drying compartment of the drying cabinet of the present invention.
Figure 9E:
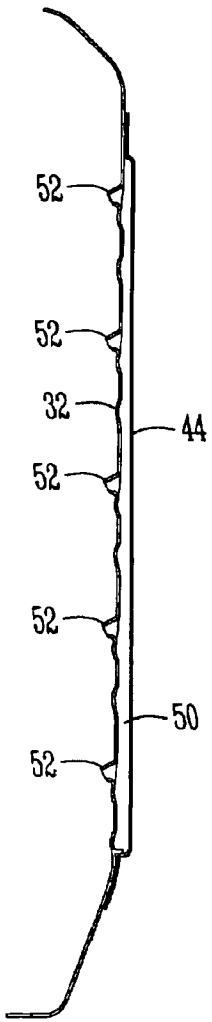
FIGS. 9A–9E are sectional views taken along lines 9A—9A through 9E—9E on FIG. 8.
Figure 9D:
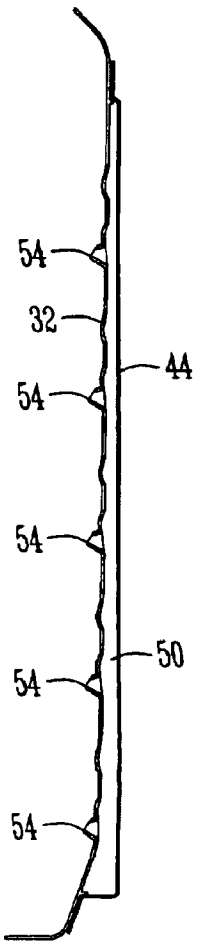
Figure 9C:
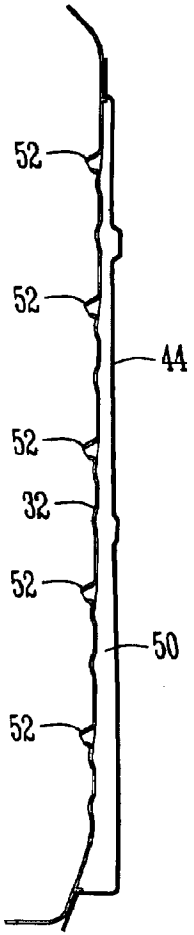
Figure 9B:
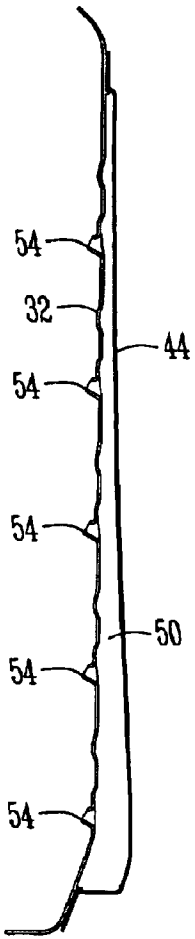
Figure 9A:
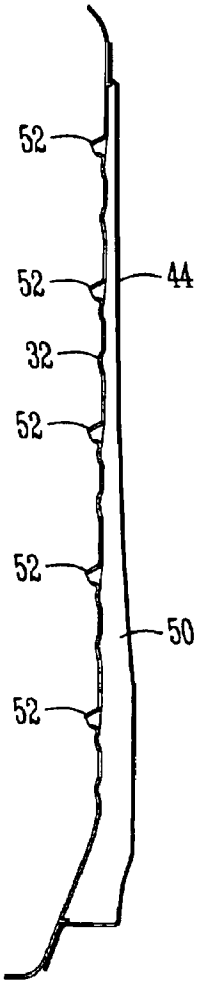
Figure 10:
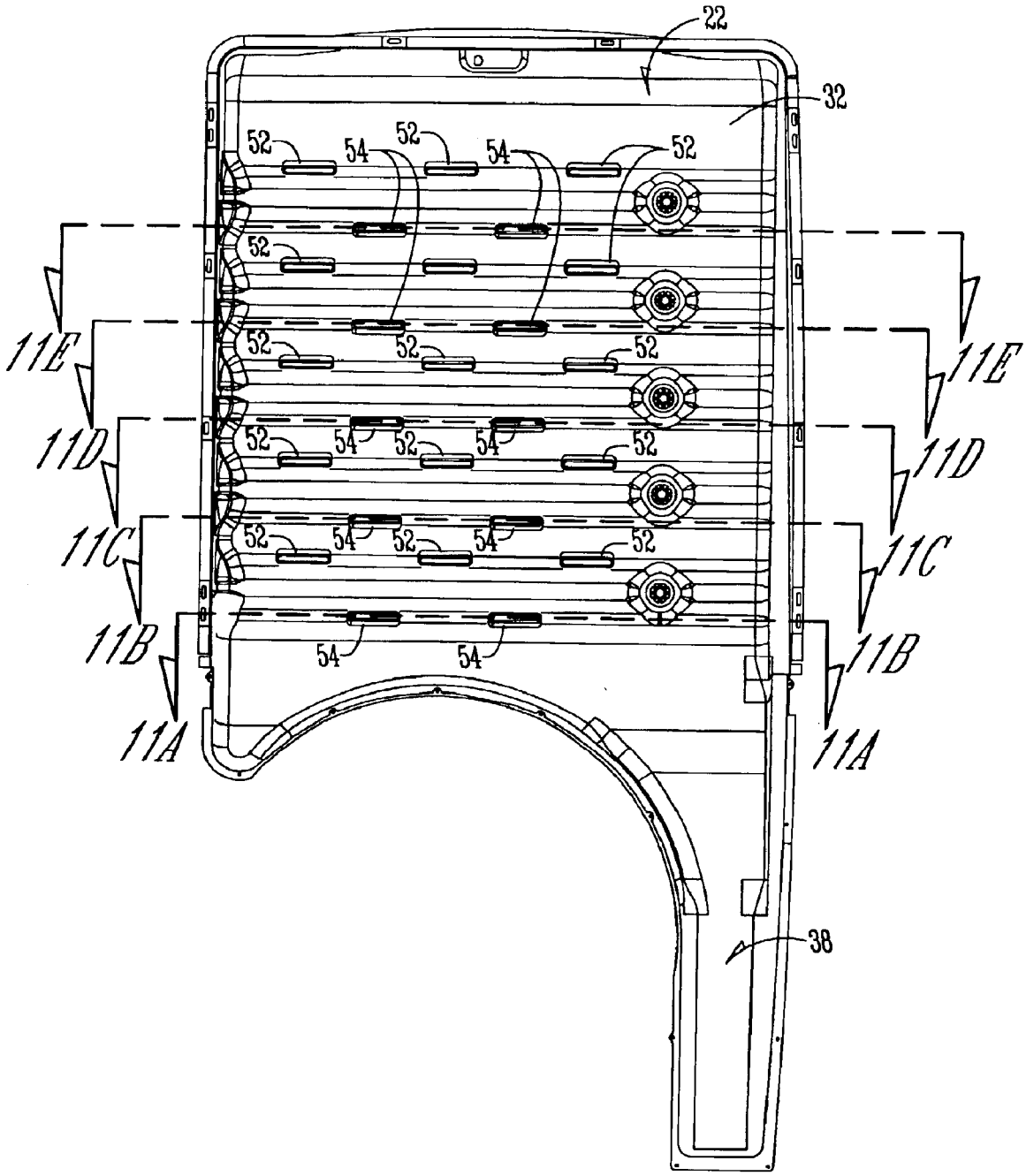
FIG. 10 is a front elevation view of the drying compartment of the present invention.
Figure 11E:
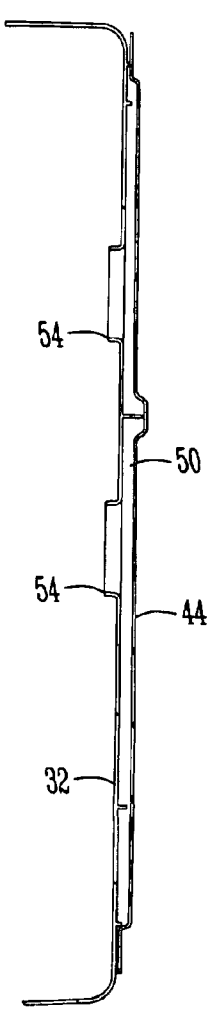
FIGS. 11A–11E are sectional views taken along lines 11A—11A through 11E—11E of FIG. 10.
Figure 11D:
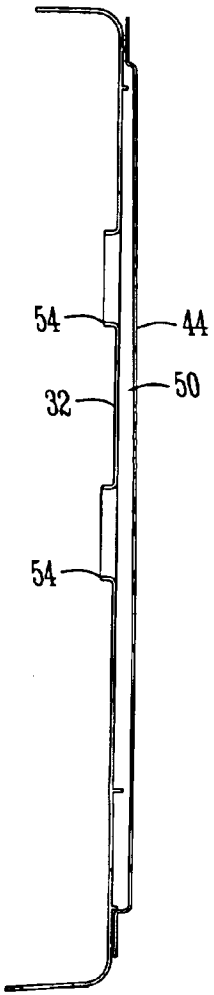
Figure 11C:
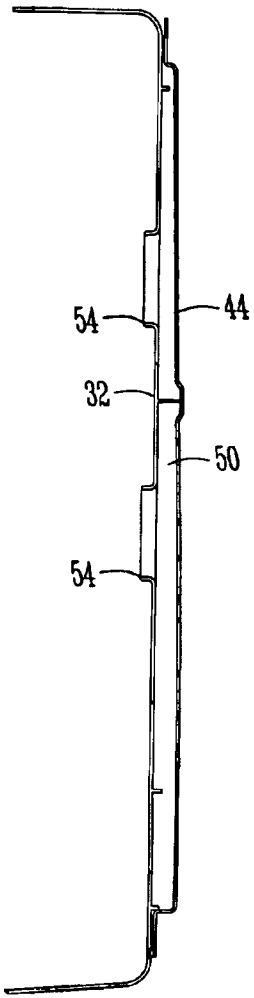
Figure 11B:
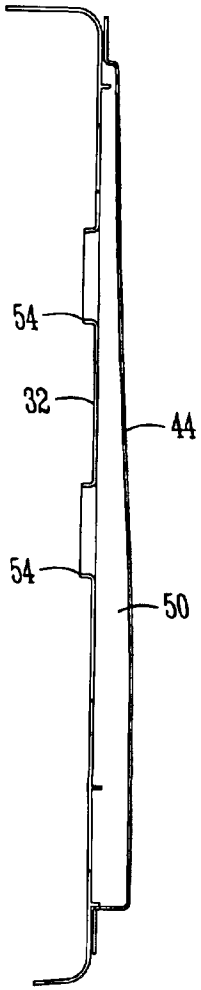
Figure 11A:
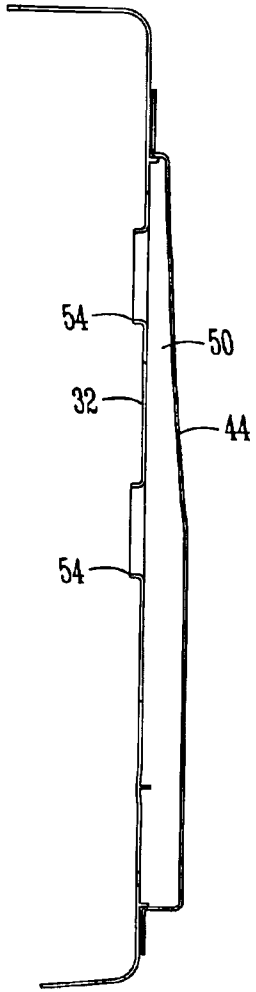

As seen in FIGS. 8 and 10, the nozzles 52, 54 are arranged in rows and columns. The nozzles 52, 54 are formed in the rear wall 32 of the compartment 22 and are angularly disposed, as best seen in FIGS. 9A–9E. More particularly, the nozzles 52 are directed downwardly, as seen in FIGS. 9A, 9C and 9E, while the nozzles 54 are directed upwardly, as seen in FIGS. 9B and 9D. Thus, when the shelves 24 are installed in the compartment 22, the nozzles 52 direct air over the top surface of the shelves 24 while the nozzles 54 direct air across the lower surface of the shelves 24. Since the shelf surface is made of a mesh material, drying of a sweater or other object placed upon the shelf 24 is optimized by the flow of air across the upper and lower sides of the object. Preferably, the air from the nozzles 52, 54 should be directed toward the shelves 24 as much as possible for optimal drying performance, as opposed to horizontally across the shelves 24. Therefore, the preferred angle of the nozzles 52, 54 is 0–45° with respect to vertical.

The preferred embodiment of the present invention has been set forth in the drawings, specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A cabinet for drying clothes, comprising:

a compartment for receiving clothes, and having a plurality of air inlet holes;

an air plenum extending upwardly along an exterior portion of the compartment, for providing air to the cabinet through the air inlet holes;

the plenum having a varying cross section to provide a balanced distribution of air through the inlet holes of the cabinet.

2. The cabinet of claim 1 wherein the compartment has opposite side walls defining a cabinet width and the plenum having a decreasing depth across the width of the cabinet.

3. The cabinet of claim 1 wherein the compartment has a top wall and a bottom wall defining a cabinet height, the plenum having a decreasing depth along the height of the cabinet.

4. The cabinet of claim 1 wherein the compartment has a width defined by opposite side walls and a height defined by top and bottom walls, and the plenum has a decreasing depth across the width of the compartment and a decreasing depth along the height of the cabinet.

5. The cabinet of claim 1 further comprising a fan in communication with the air plenum for supplying air to the plenum.

6. The cabinet of claim 1 wherein the plenum has four corners, with an air inlet in one of the corners.

7. The cabinet of claim 1 wherein the plenum has a cross sectional area that is reduced from the air inlet corner to an opposite corner.

8. The cabinet of claim 7 wherein the cross sectional area of the plenum is reduced in a radial pattern.

9. The cabinet of claim 1 further comprising an air duct communicating with the plenum.

10. The cabinet of claim 9 wherein the cross sectional area of the plenum reduces from the air duct to the air inlet hole furthest from the air inlet.

11. A clothes drying cabinet comprising:

a compartment having a front door, opposite upright side walls, an upright rear wall, a top wall and a bottom wall;

one of the upright walls having air inlet holes;

an air plenum behind the upright wall with the inlet holes;

an air supply communicating with the air plenum; and the air plenum having a varying cross sectional area to provide substantially constant velocity of air distribution through the air inlet holes to the compartment.

12. The cabinet of claim 11 wherein the air supply includes a fan and an air duct for directing air from the fan to the air plenum.

13. The cabinet of claim 12 wherein the cross sectional area of the air plenum decreases with distance from the air duct.

14. The cabinet of claim 11 wherein the air plenum has a depth which decreases laterally from one side wall to the other side wall.

15. The cabinet of claim 11 wherein the air plenum has a depth which decreases vertically between the bottom and top walls.

16. The cabinet of claim 11 wherein the air plenum has a depth which decreases laterally and vertically.

17. The cabinet of claim 11 wherein the plenum has four corners and the air supply is connected to one of the corners.

18. The cabinet of claim 17 wherein the plenum has a cross sectional area that decreases from the corner with the air supply to an opposite corner.

19. The cabinet of claim 17 wherein the cross sectional area of the plenum decreases from the air supply corner in a radial pattern.

20. The cabinet of claim 11 wherein the plenum is defined by the rear wall of the compartment and a back panel mounted over the rear wall in spaced relation thereto.

21. A cabinet for drying clothes, comprising:

a compartment for receiving clothes, and having a plurality of vertical spaced air inlet nozzles;

an air plenum extending upwardly outside the compartment for directing air through the nozzles and into the cabinet; and the nozzles being angled in multiple directions to direct air into the compartment at multiple directions relative to a horizontal plane.

22. The cabinet of claim 21 wherein the nozzles include first and second sets, with the first set being directed upwardly and the second set being directed downwardly.

23. The cabinet of claim 21 wherein the nozzles are arranged in a pattern to alternate the direction air is directed into the compartment.

24. The cabinet of claim 21 further comprising a plurality of shelves in the compartment, and the nozzles direct air to upper and lower surfaces of each shelf.

25. The cabinet of claim 21 wherein the nozzles include multiple columns which alternately direct air upwardly and downwardly into the compartment.

26. The cabinet of claim 21 wherein the nozzles include multiple rows which alternatingly direct air upwardly and downwardly into the compartment.

27. The cabinet of claim 21 wherein the compartment includes a rear wall with the nozzles located therein.

28. The cabinet of claim 21 wherein the nozzles are formed in the rear wall.

29. The cabinet of claim 21 wherein the nozzles are angled in non-horizontal directions.

30. The cabinet of claim 21 wherein the nozzles are angled between 0–45° with respect to vertical.

31. The cabinet of claim 21 wherein the nozzles are in a pattern of rows and columns with adjacent rows and columns directing air in different directions into the compartment.

32. A clothes drying cabinet, comprising:

a compartment having a front door, opposite upright side walls, an upright rear wall, a top wall and a bottom wall;

a first set of air nozzles in one of the upright walls of the compartment to direct air in a first direction relative to a horizontal plane into the compartment; and a second set of air nozzles in one of the upright walls of the compartment to direct air in a second direction relative to a horizontal plane into the compartment.

33. The cabinet of claim 32 wherein the first direction is upwardly.

34. The cabinet of claim 32 wherein the second direction is downwardly.

35. The cabinet of claim 32 wherein the first and second directions are non-horizontal.

36. The cabinet of claim 32 wherein the first and second sets of nozzles are arranged in alternating columns.

37. The cabinet of claim 32 wherein the first and second sets of nozzles are arranged in alternating rows.

38. The cabinet of claim 32 wherein the nozzles are in the back wall.

39. The cabinet of claim 38 wherein the nozzles are integrally formed in the back wall.

40. The cabinet of claim 32 further comprising a plurality of shelves mounted in the compartment.

41. The cabinet of claim 40 wherein the nozzles direct air across upper and lower surfaces of the shelves.

* * * * *